US010378796B2

(12) United States Patent
Fredslund et al.

(10) Patent No.: US 10,378,796 B2
(45) Date of Patent: Aug. 13, 2019

(54) METHOD FOR CONTROLLING A VALVE ARRANGEMENT IN A VAPOUR COMPRESSION SYSTEM

(71) Applicant: DANFOSS A/S, Nordborg (DK)

(72) Inventors: Kristian Fredslund, Haderslev (DK); Jan Prins, Nordborg (DK); Kenneth Bank Madsen, Ry (DK); Frede Schmidt, Sønderborg (DK)

(73) Assignee: Danfoss A/S, Nordborg (DK)

( * ) Notice: Subject to any disclaimer, the term of this patent is extended or adjusted under 35 U.S.C. 154(b) by 171 days.

(21) Appl. No.: 15/531,989

(22) PCT Filed: Oct. 8, 2015

(86) PCT No.: PCT/EP2015/073211

§ 371 (c)(1),
(2) Date: May 31, 2017

(87) PCT Pub. No.: WO2016/091418

PCT Pub. Date: Jun. 16, 2016

(65) Prior Publication Data

US 2017/0343245 A1 Nov. 30, 2017

(30) Foreign Application Priority Data

Dec. 9, 2014 (EP) ..... 14196946

(51) Int. Cl.

| | |
|---|---|
| ***F25B 9/00*** | (2006.01) |
| ***F25B 41/00*** | (2006.01) |
| ***F25B 41/04*** | (2006.01) |
| ***F25B 49/02*** | (2006.01) |

(52) U.S. Cl.

CPC ..... *F25B 9/008* (2013.01); *F25B 41/00* (2013.01); *F25B 41/043* (2013.01); *F25B 49/02* (2013.01);

(Continued)

(58) Field of Classification Search

CPC ..... F25B 49/02; F25B 41/043; F25B 2400/0407; F25B 2700/21175;

(Continued)

(56) References Cited

U.S. PATENT DOCUMENTS 5,553,457 A * 9/1996 Reznikov ..... F25B 5/04 62/198
6,584,794 B2 * 7/2003 Takeuchi ..... F25B 41/00 62/278

(Continued)

FOREIGN PATENT DOCUMENTS

| | | |
|---|---|---|
| CN | 103282730 A | 9/2013 |
| JP | H04-320762 A | 11/1992 |
| JP | 2001-221517 A | 8/2001 |

OTHER PUBLICATIONS

International Search Report for PCT Serial No. PCT/EP/2015/073211 dated Jan. 11, 2016.

*Primary Examiner* — Kun Kai Ma
(74) *Attorney, Agent, or Firm* — McCormick, Paulding & Huber LLP

(57) ABSTRACT

A method for controlling a valve arrangement (12), e.g. in the form of a three way valve, in a vapor compression system (1) is disclosed, the vapor compression system (1) comprising an ejector (6). The valve arrangement (12) is arranged to supply refrigerant to a compressor unit (2) from the gaseous outlet (11) of a receiver (7) and/or from the outlet of an evaporator (9). The vapor compression system (1) may be operated in a first mode of operation (summer mode) or in a second mode of operation (winter mode). When operated in the second mode of operation, it is determined whether or not conditions for operating the vapor compression system (1) in the first mode of operation are prevailing. If this is the case, the valve arrangement (12) is actively switched to the first mode of operation by closing (Continued)

a first inlet (13) towards the evaporator (7) and fully opening a second inlet (14) towards the receiver (7).

20 Claims, 1 Drawing Sheet

(52) U.S. Cl.
CPC . *F25B 2309/061* (2013.01); *F25B 2341/0012* (2013.01); *F25B 2341/0662* (2013.01); *F25B 2400/0407* (2013.01); *F25B 2400/13* (2013.01); *F25B 2400/23* (2013.01); *F25B 2500/31* (2013.01); *F25B 2600/2507* (2013.01); *F25B 2700/195* (2013.01); *F25B 2700/2109* (2013.01); *F25B 2700/21151* (2013.01); *F25B 2700/21175* (2013.01)

(58) Field of Classification Search
CPC ..... F25B 2341/0012; F25B 2700/2109; F25B 2600/2507; F25B 2700/21151
See application file for complete search history.

(56) References Cited

U.S. PATENT DOCUMENTS 7,334,427 B2 * 2/2008 Ozaki ..... F04F 5/04 62/500
2004/0003608 A1 * 1/2004 Takeuchi ..... B60H 1/3204 62/170
2004/0011065 A1 * 1/2004 Takeuchi ..... F25B 9/008 62/170
2004/0040340 A1 * 3/2004 Takeuchi ..... B60H 1/3204 62/500
2004/0060316 A1 * 4/2004 Ito ..... B60H 1/00328 62/324.1
2004/0103685 A1 * 6/2004 Yamaguchi ..... B60H 1/00899 62/500
2004/0255602 A1 * 12/2004 Sato ..... F25B 6/00 62/159
2004/0255613 A1 * 12/2004 Choi ..... F25B 41/00 62/500
2012/0167601 A1 * 7/2012 Cogswell ..... F25B 1/10 62/115
2013/0042640 A1 * 2/2013 Higashiiue ..... F25B 41/00 62/196.1
2013/0125569 A1 * 5/2013 Verma ..... F25B 1/10 62/115
2015/0300706 A1 * 10/2015 Awa ..... F25B 29/003 62/324.6
2016/0280041 A1 * 9/2016 Suzuki ..... B60H 1/00921
2017/0321941 A1 * 11/2017 Fredslund ..... F25B 49/02
2017/0343245 A1 * 11/2017 Fredslund ..... F25B 9/008
2018/0283750 A1 * 10/2018 Prins ..... F25B 9/08
2018/0320944 A1 * 11/2018 Prins ..... F25B 49/022

* cited by examiner

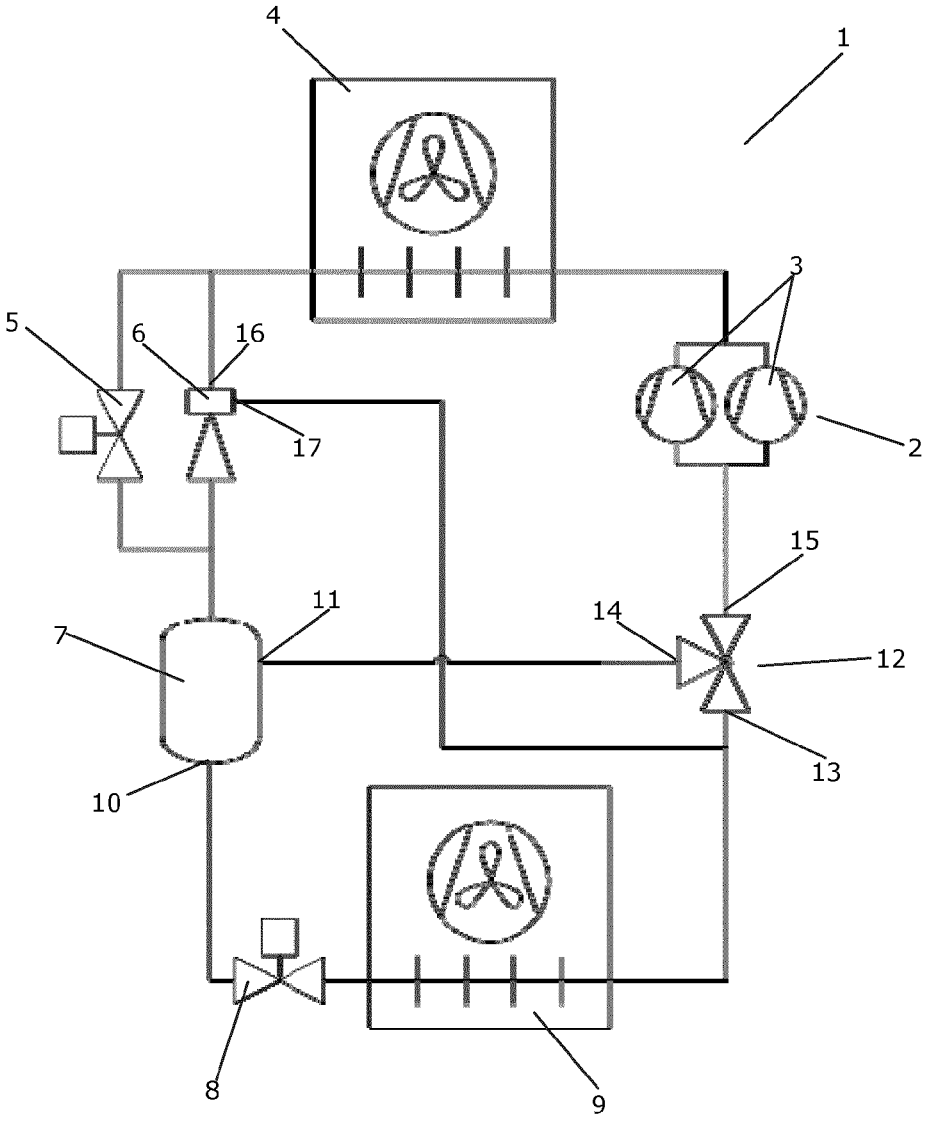
4
1
3
5
6
16
17
2
15
11
14
7
12
13
10
8
9

METHOD FOR CONTROLLING A VALVE ARRANGEMENT IN A VAPOUR COMPRESSION SYSTEM

CROSS-REFERENCE TO RELATED APPLICATIONS

This application is a National Stage application of International Patent Application No. PCT/EP2015/073211, filed on Oct. 8, 2015, which claims priority to European Patent Application No. 14196946.9, filed on Dec. 9, 2014, each of which is hereby incorporated by reference in its entirety.

TECHNICAL FIELD

The present invention relates to a method for controlling a valve arrangement in a vapour compression system, the valve arrangement being arranged to control a supply of refrigerant to a compressor unit of the vapour compression system.

BACKGROUND

In some vapour compression systems an ejector is arranged in a refrigerant path, at a position downstream relative to a heat rejecting heat exchanger. Thereby refrigerant leaving the heat rejecting heat exchanger is supplied to a primary inlet of the ejector. Refrigerant leaving an evaporator of the vapour compression system is supplied to a secondary inlet of the ejector.

An ejector is a type of pump which uses the Venturi effect to increase the pressure energy of a fluid at a suction inlet (or secondary inlet) of the ejector by means of a motive fluid supplied to a motive inlet (or primary inlet) of the ejector. Thereby, arranging an ejector in the refrigerant path as described will cause the refrigerant to perform work, and thereby the power consumption of the vapour compression system is reduced as compared to the situation where no ejector is provided. It is desirable to allow as large a portion as possible of the refrigerant leaving the evaporator to be supplied to the secondary inlet of the ejector.

An outlet of the ejector is normally connected to a receiver, in which liquid refrigerant is separated from gaseous refrigerant. The liquid part of the refrigerant is supplied to the evaporator, via an expansion device. The gaseous part of the refrigerant may be supplied to a compressor. Thereby the gaseous part of the refrigerant is not subjected to the pressure drop introduced by the expansion device, and the work required in order to compress the refrigerant can therefore be reduced.

When the ambient temperature is high, such as during the summer period, the temperature as well as the pressure of the refrigerant leaving the heat rejecting heat exchanger is relatively high. In this case the ejector performs well, and it is advantageous to supply all of the refrigerant leaving the evaporator to the secondary inlet of the ejector, and to supply gaseous refrigerant to the compressors from the receiver only. When the vapour compression system is operated in this manner, it is sometimes referred to as 'summer mode'.

On the other hand, when the ambient temperature is low, such as during the winter period, the temperature as well as the pressure of the refrigerant leaving the heat rejecting heat exchanger is relatively low. In this case the ejector is not performing well, and it is advantageous to supply the refrigerant leaving the evaporator to the compressors, instead of to the secondary inlet of the ejector. When the vapour compression system is operated in this manner, it is sometimes referred to as 'winter mode'.

When the ambient temperature decreases in such a manner that a switch from a 'summer mode' operation of the vapour compression system to a 'winter mode' operation of the vapour compression system is required, such a switch can be ensured relatively easy on the basis of the pressure inside the receiver. However, when the ambient temperature increases in such a manner that a switch from a 'winter mode' operation of the vapour compression system to a 'summer mode' operation of the vapour compression system is required, or more beneficial, such a switch may not occur automatically during operation of the vapour compression system. It may therefore be desirable to take measures to ensure that a switch to the 'summer mode' is in fact performed in this situation.

US 2012/0167601 A1 discloses an ejector cycle. A heat rejecting heat exchanger is coupled to a compressor to receive compressed refrigerant. An ejector has a primary inlet coupled to the heat rejecting heat exchanger, a secondary inlet and an outlet. A separator has an inlet coupled to the outlet of the ejector, a gas outlet and a liquid outlet. The system can be switched between first and second modes. In the first mode refrigerant leaving the heat absorbing heat exchanger is supplied to the secondary inlet of the ejector. In the second mode refrigerant leaving the heat absorbing heat exchanger is supplied to the compressor.

SUMMARY

It is a further object of embodiments of the invention to provide a method for controlling a valve arrangement in a vapour compression system, in which an energy efficient operation of the vapour compression system is ensured in an easy manner.

The invention provides a method for controlling a valve arrangement in a vapour compression system, the vapour compression system comprising a compressor unit comprising one or more compressors, a heat rejecting heat exchanger, an ejector, a receiver, an expansion device and an evaporator arranged in a refrigerant path, wherein an outlet of the heat rejecting heat exchanger is connected to a primary inlet of the ejector, an outlet of the ejector is connected to the receiver, an outlet of the evaporator is connected to a secondary inlet of the ejector and to a first inlet of the valve arrangement, a gaseous outlet of the receiver is connected to a second inlet of the valve arrangement, and an outlet of the valve arrangement is connected to an inlet of the compressor unit, the valve arrangement thereby being arranged to supply refrigerant to the compressor unit from the gaseous outlet of the receiver and/or from the outlet of the evaporator, the method comprising the steps of:

- defining a first mode of operation of the vapour compression system, in which the valve arrangement is operated to keep the first inlet of the valve arrangement closed and to keep the second inlet of the valve arrangement open,
- defining a second mode of operation of the vapour compression system, in which the valve arrangement is operated to keep the first inlet of the valve arrangement open and to operate the second inlet of the valve arrangement to bypass vapour in order to maintain a pressure level in the receiver,
- in the case that the vapour compression system is operated in the second mode of operation:

determining whether or not conditions for operating the vapour compression system in the first mode of operation are prevailing, and in the case that conditions for operating the vapour compression system in the first mode of operating are prevailing, actively closing the first inlet of the valve arrangement and fully opening the second inlet of the valve arrangement.

The invention provides a method for controlling a valve arrangement in a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The vapour compression system comprises a compressor unit comprising one or more compressors, a heat rejecting heat exchanger, an ejector, a receiver, an expansion device, e.g. in the form of an expansion valve, and an evaporator arranged in a refrigerant path.

An outlet of the heat rejecting heat exchanger is connected to a primary inlet of the ejector. Accordingly, refrigerant leaving the heat rejecting heat exchanger is supplied to the primary inlet of the ejector.

An outlet of the ejector is connected to the receiver. Accordingly, refrigerant leaving the ejector is supplied to the receiver.

An outlet of the evaporator is connected to a secondary inlet of the ejector and to a first inlet of the valve arrangement. Accordingly, refrigerant leaving the evaporator may be supplied to the secondary inlet of the ejector and/or to the valve arrangement, via the first inlet. All of the refrigerant leaving the evaporator may be supplied to the secondary inlet of the ejector. As an alternative, all of the refrigerant leaving the evaporator may be supplied to the first inlet of the valve arrangement. As another alternative, some of the refrigerant leaving the evaporator may be supplied to the secondary inlet of the ejector, and some of the refrigerant leaving the evaporator may be supplied to the first inlet of the valve arrangement. This will be described in further detail below.

A gaseous outlet of the receiver is connected to a second inlet of the valve arrangement. Accordingly, a gaseous part of the refrigerant in the receiver is supplied to the valve arrangement, via the second inlet.

An outlet of the valve arrangement is connected to an inlet of the compressor unit. Accordingly, the valve arrangement is arranged to supply refrigerant to the compressor unit from the gaseous outlet of the receiver, via the second inlet of the valve arrangement, and/or from the outlet of the evaporator, via the first inlet of the valve arrangement. Thus, in the case that the first inlet of the valve arrangement is closed and the second inlet of the valve arrangement is open, refrigerant is supplied from the gaseous outlet of the receiver to the compressor unit, but no refrigerant is supplied from the outlet of the evaporator to the compressor unit. In the case that the first inlet of the valve arrangement is open and the second inlet of the valve arrangement is closed, refrigerant is supplied from the outlet of the evaporator to the compressor unit, but no refrigerant is supplied from the gaseous outlet of the receiver to the compressor unit. In the case that the first inlet of the valve arrangement as well as the second inlet of the valve arrangement is open, refrigerant is supplied to the compressor unit from the outlet of the evaporator as well as from the gaseous outlet of the receiver. Finally, in the case that the first inlet of the valve arrangement as well as the second inlet of the valve arrangement is closed, no refrigerant is supplied to the compressor unit. Furthermore, the valve arrangement can be operated to select one of the options described above, in accordance with the current operating conditions.

Refrigerant flowing in the refrigerant path is compressed by the compressor(s) of the compressor unit. The compressed refrigerant is supplied to the heat rejecting heat exchanger, where heat exchange takes place with the ambient in such a manner that heat is rejected from the refrigerant flowing through the heat rejecting heat exchanger. In the case that the heat rejecting heat exchanger is in the form of a condenser, the refrigerant is at least partly condensed when passing through the heat rejecting heat exchanger. In the case that the heat rejecting heat exchanger is in the form of a gas cooler, the refrigerant flowing through the heat rejecting heat exchanger is cooled, but it remains in a gaseous state.

From the heat rejecting heat exchanger, the refrigerant is supplied to the primary inlet of the ejector, and from the outlet of the ejector the refrigerant is supplied to the receiver. In the receiver, the refrigerant is separated into a liquid part and a gaseous part. The liquid part of the refrigerant is supplied to the expansion device, where the refrigerant is expanded before being supplied to the evaporator. The refrigerant being supplied to the evaporator is thereby in a mixed gaseous and liquid state. In the evaporator, the liquid part of the refrigerant is at least partly evaporated, while heat exchange takes place with the ambient in such a manner that heat is absorbed by the refrigerant flowing through the evaporator.

From the outlet of the evaporator the refrigerant is supplied to the secondary inlet of the ejector and/or to the compressor unit, via the valve arrangement, as described above.

The gaseous part of the refrigerant in the receiver may be supplied to the compressor unit, via the valve arrangement, as described above. Thereby the gaseous refrigerant is not subjected to the pressure drop introduced by the expansion device, and energy consumed by the compressors is reduced.

Thus, at least part of the refrigerant flowing in the refrigerant path is alternatingly compressed by the compressors and expanded by the expansion device, while heat exchange takes place at the heat rejecting heat exchanger and at the evaporator. Thereby cooling or heating of a volume can be obtained.

According to the method of the invention, a first mode of operation of the vapour compression system and a second mode of operation of the vapour compression system are initially defined.

In the first mode of operation of the vapour compression system, the valve arrangement is operated to keep the first inlet of the valve arrangement closed and to keep the second inlet of the valve arrangement open. Thus, when the vapour compression system is operated in the first mode of operation, refrigerant is supplied from the gaseous outlet of the receiver to the compressor unit, but no refrigerant is supplied from the outlet of the evaporator to the compressor unit. Instead, the refrigerant leaving the evaporator is supplied to the secondary inlet of the ejector. This corresponds to the 'summer mode' described above.

In the second mode of operation of the vapour compression system, the valve arrangement is operated to keep the first inlet of the valve arrangement open and to operate the second inlet of the valve arrangement to bypass vapour in order to maintain a pressure level in the receiver. Thus, when the vapour compression system is operated in the second mode of operation, refrigerant is supplied from the outlet of the evaporator to the compressor unit. The second inlet of the valve arrangement will be closed most of the time, i.e. refrigerant will, as a rule, not be supplied from the gaseous outlet of the receiver to the compressor unit. However, in the case that the pressure inside the receiver increases above a maximum threshold value, the second inlet of the valve arrangement is opened in order to allow gaseous refrigerant to pass directly from the receiver to the compressor unit, bypassing the expansion device and the evaporator. This corresponds to the 'winter mode' described above.

In the case that the vapour compression system is operated in the second mode of operation, it is determined whether or not conditions for operating the vapour compression system in the first mode of operation are prevailing. This should be interpreted to include investigating whether or not it would be more beneficial, e.g. with respect to energy consumption of the vapour compression system, to operate the vapour compression system in the first mode of operation, instead of in the second mode of operation. This will be described in further detail below.

In the case that it is determined that conditions for operating the vapour compression system in the first mode of operation are prevailing, the valve arrangement is operated in such a manner that the first inlet of the valve arrangement is actively closed, and the second inlet of the valve arrangement is fully opened. Thus, in this case a refrigerant flow from the outlet of the evaporator to the compressor unit is actively prevented, thereby forcing all of the refrigerant leaving the evaporator to be supplied to the secondary inlet of the ejector. Furthermore, it is ensured that as much gaseous refrigerant as possible, possibly all of the available gaseous refrigerant, is supplied from the gaseous outlet of the receiver to the compressor unit. Accordingly, the valve arrangement is actively forced into a state where the vapour compression system is operated in the first mode of operation.

As described above, an automatic switch from the second mode of operation (corresponding to a 'winter mode') to the first mode of operation (corresponding to a 'summer mode') is not necessarily obtained during operation of the vapour compression system, even though the conditions for operating the vapour compression system in the first mode of operation are present. It is therefore an advantage of the present invention that the valve arrangement is actively forced into a state causing such a switch when it is detected that such conditions are prevailing. Thereby it is prevented that the vapour compression system is continuously operated in a mode of operation which is no longer optimal under the given circumstances, and an energy efficient operation of the vapour compression system is ensured, even if the ambient temperature, or other relevant operating conditions, changes. Furthermore, the switch to the first mode of operation can be performed in an easy manner, simply by operating the valve arrangement.

The step of determining whether or not conditions for operating the vapour compression system in the first mode of operation are prevailing may comprise the steps of:

determining a distribution of refrigerant supplied to the valve arrangement, including determining how large a portion of the refrigerant being supplied from the outlet of the valve arrangement to the compressor unit is received in the valve arrangement via the first inlet, and how large a portion is received via the second inlet, and determining that conditions for operating the vapour compression system in the first mode of operation are prevailing if the portion of refrigerant received via the second inlet of the valve arrangement exceeds a predefined percentage of the refrigerant supplied from the outlet of the valve arrangement to the inlet of the compressor unit, said predefined percentage being at least 70%.

According to this embodiment, determining whether or not conditions for operating the vapour compression system in the first mode of operation are prevailing is based on the distribution of refrigerant supplied to the compressor unit via the first and the second inlet of the valve arrangement, respectively. Thus, it is investigated how much refrigerant is received from the outlet of the evaporator, and how much refrigerant is received from the gaseous outlet of the receiver.

If a large portion of the refrigerant supplied to the compressor unit originates from the gaseous outlet of the receiver, this is an indication that the ejector is in fact performing well. Therefore, in this case it will be beneficial to operate the vapour compression system in the first mode of operation, i.e. in a 'summer mode'.

Therefore, in the case that it turns out that the portion of refrigerant received via the second inlet of the valve arrangement, i.e. from the gaseous outlet of the receiver, exceeds at least 70% of the refrigerant supplied to the compressor unit, then it is determined that the conditions for operating the vapour compression system in the first mode of operation are prevailing.

The step of determining a distribution of refrigerant supplied to the valve arrangement may comprise measuring a temperature of refrigerant entering the valve arrangement via the first inlet, a temperature of refrigerant entering the valve arrangement via the second inlet, and a temperature of refrigerant leaving the valve arrangement via the outlet, and comparing the measured temperatures.

The temperature of refrigerant received from the gaseous outlet of the receiver must be expected to be higher than the temperature of refrigerant received from the outlet of the evaporator. Therefore, by comparing the temperature at the first inlet of the valve arrangement and at the second inlet of the valve arrangement, respectively, to the temperature at the outlet of the valve arrangement, it is possible to calculate how large a portion of the refrigerant being supplied to the compressor unit, via the outlet of the valve arrangement, originates from the gaseous outlet of the receiver, and how large a portion originates from the outlet of the evaporator.

Furthermore, in the case that conditions for operating the vapour compression system in the first mode of operation are present, the ejector may be capable of sucking more refrigerant into the secondary outlet of the ejector than the amount of refrigerant leaving the outlet of the evaporator. This may have the consequence that refrigerant delivered to the valve arrangement via the second inlet is sucked out of the valve arrangement via the first inlet and supplied to the secondary inlet of the ejector, instead of being supplied to the inlet of the compressor unit, via the outlet of the valve arrangement. Thereby refrigerant is simply circulated between the ejector, the receiver and the valve arrangement, and this is undesirable. When this occurs, the temperature of the refrigerant at the first inlet and/or at the outlet will be higher than expected. Therefore, measuring the temperatures of the refrigerant at the first inlet, the second inlet and the outlet of the valve arrangement, and comparing the measured temperatures can reveal if the situation described above is occurring. Furthermore, the situation described above can be alleviated by closing the first inlet of the valve arrangement, thereby preventing that refrigerant leaves the valve arrangement via the first inlet.

Alternatively or additionally, the step of determining a distribution of refrigerant supplied to the valve arrangement may comprise determining an opening degree of the second inlet of the valve arrangement. In the case that the opening degree of the second inlet of the valve arrangement is large, it must be expected that a large portion of the refrigerant being supplied to the compressor unit originates from the second inlet of the valve arrangement, i.e. from the gaseous outlet of the receiver. Similarly, in the case that the opening degree of the second inlet of the valve arrangement is small, it must be expected that only a small portion of the refrigerant being supplied to the compressor unit originates from the second inlet of the valve arrangement. Accordingly, determining the opening degree of the second inlet of the valve arrangement provides information relating to the distribution of refrigerant supplied to the compressor unit.

Alternatively or additionally, the step of determining a distribution of refrigerant supplied to the valve arrangement may comprise the step of determining a flow direction of refrigerant at the first inlet of the valve arrangement. As described above, in the case that conditions for operating the vapour compression system in the first mode of operation are present, there may be a risk that refrigerant supplied to the valve arrangement from the gaseous outlet of the receiver, via the second inlet of the valve arrangement, is sucked out of the valve arrangement via the first inlet, and supplied to the secondary inlet of the ejector. Therefore, determining a flow direction of refrigerant at the first inlet of the valve arrangement will reveal whether or not this situation is occurring. If the refrigerant flows in a direction away from the valve arrangement, then the situation described above is occurring. On the other hand, if the refrigerant flows in a direction towards the valve arrangement, then the situation described above is not occurring.

The flow direction of refrigerant at the first inlet of the valve arrangement may, e.g., be determined by measuring the temperatures of refrigerant at the first inlet of the valve arrangement, at the second inlet of the valve arrangement and at the outlet of the valve arrangement, and comparing the measured temperatures, as described above.

As an alternative, the step of determining a flow direction of refrigerant at the first inlet of the valve arrangement may comprise the steps of:

- modulating an opening degree of the first inlet of the valve arrangement, and
- measuring changes in a pressure of refrigerant at the first inlet of the valve arrangement in response to the modulation of the opening degree of the first inlet of the valve arrangement.

In the present context the term 'modulating an opening degree' should be interpreted to mean alternatingly increasing and decreasing the opening degree.

If the refrigerant at the first inlet of the valve arrangement flows in a direction away from the valve arrangement, then the pressure at the first inlet of the valve arrangement decreases when the opening degree of the first inlet decreases, and increases when the opening degree of the first inlet increases. However, if the refrigerant at the first inlet of the valve arrangement flows in a direction towards the valve arrangement, then the pressure at the first inlet of the valve arrangement increases when the opening degree of the first inlet decreases, and decreases when the opening degree of the first inlet increases. Accordingly, measuring the pressure of refrigerant at the first inlet of the valve arrangement, in response to modulations of the opening degree of the first inlet of the valve arrangement, provides information regarding the flow direction of refrigerant at the first inlet of the valve arrangement.

The step of determining whether or not conditions for operating the vapour compression system in the first mode of operation are prevailing may comprise the steps of:

- measuring a parameter of the vapour compression system, where an enthalpy of refrigerant leaving the heat rejecting heat exchanger can be derived from the measured parameter, and
- determining that conditions for operating the vapour compression system in the first mode of operation are prevailing if the measured parameter exceeds a predefined threshold value.

According to this embodiment, the measured parameter is of such a kind that an enthalpy of refrigerant leaving the heat rejecting heat exchanger can be derived from the measured parameter. Thus, the measured parameter provides information regarding the enthalpy of the refrigerant leaving the heat rejecting heat exchanger, and thereby information relating to internal energy and pressure of the refrigerant. Whether or not conditions for operating the vapour compression system in the first mode of operation are prevailing depends on these properties. Therefore a measured parameter as defined above is suitable for determining whether or not conditions for operating the vapour compression system in the first mode of operation are prevailing.

The measured parameter could, e.g., be or comprise an ambient temperature prevailing in a region of the heat rejecting heat exchanger, a temperature of refrigerant leaving the heat rejecting heat exchanger, and/or a pressure of refrigerant leaving the heat rejecting heat exchanger.

The valve arrangement may be or comprise a three way valve. According to this embodiment, the supply of refrigerant to the compressor unit, including whether to operate the vapour compression system in the first mode of operation or in the second mode of operation, is performed in a very easy manner, and by means of only one component, i.e. the three way valve. Since the three way valve is, according to this embodiment, capable of operating as a bypass valve when the vapour compression system is operating in the second mode of operation, a separate bypass valve is not required. This reduces the component count, and thereby the manufacturing costs, of the vapour compression system.

As an alternative, the valve arrangement may comprise separate valves at the first inlet and the second inlet, e.g. in the form of one way valves or check valves.

The vapour compression system may further comprise a high pressure valve interconnecting an outlet of the heat rejecting heat exchanger and an inlet of the receiver, the high pressure valve being arranged in parallel to the ejector, and refrigerant leaving the heat rejecting heat exchanger may be divided into a flow passing through the high pressure valve and a flow passing through the ejector, via the primary inlet of the ejector. According to this embodiment, it is possible to adjust how large a portion of the refrigerant leaving the heat rejecting heat exchanger it is desired to pass through the ejector.

The vapour compression system may be arranged to have a transcritical refrigerant, such as $CO_2$, flowing in the refrigerant path. In vapour compression systems of this kind, the pressure prevailing in the high pressure part of the system is normally relatively high. It is therefore very relevant to reduce the work required by the compressors in order to compress the refrigerant in vapour compression systems of this kind.

The heat rejecting heat exchanger may be a gas cooler. In this case the refrigerant flowing through the heat rejecting heat exchanger remains in a gaseous phase, and the gaseous refrigerant is merely cooled due to the heat exchange taking place in the heat rejecting heat exchanger. Gas coolers are typically applied when a transcritical refrigerant, such as $CO_2$, is used in the vapour compression system.

As an alternative, the heat rejecting heat exchanger may be a condenser. In this case the refrigerant passing through the heat rejecting heat exchanger is at least partly condensed, during the heat exchange taking place.

Above it has been described how a switch from operating the vapour compression system in the second mode of operation to operating the vapour compression system in the first mode of operation is performed. When, on the other hand, the vapour compression system is operated in the first mode of operation, but it is in fact more beneficial to operate the vapour compression system in the second mode of operation, a switch to the second mode of operation may be ensured in the following manner.

A pressure of refrigerant leaving the evaporator may initially be detected, and it may be detected whether or not the first inlet of the valve arrangement is closed, which is expected since the vapour compression system is operated in the first mode of operation. If the first inlet of the valve arrangement is closed, this is an indication that all of the refrigerant leaving the evaporator is supplied to the secondary inlet of the ejector. Accordingly, the refrigerant performs work to the greatest possible extend. However, in this case it must be ensured that the pressure of the refrigerant leaving the evaporator does not decrease below an acceptable level. Therefore, the detected pressure of refrigerant leaving the evaporator is compared to a lower threshold value and to an upper threshold value.

If the comparison reveals that the detected pressure of refrigerant leaving the evaporator is below the lower threshold value, this is an indication that there is a risk that the pressure of refrigerant leaving the evaporator decreases below an acceptable level. It is therefore desirable to increase the pressure of the refrigerant leaving the evaporator. This can be obtained by decreasing the mass flow of refrigerant being supplied from the outlet of the evaporator to the secondary inlet of the ejector.

In order to obtain this, the compressor unit is operated in order to increase the pressure inside the receiver.

If the comparison reveals that the detected pressure of refrigerant leaving the evaporator is above the upper threshold value, this is an indication that the amount of refrigerant being supplied from the outlet of the evaporator to the secondary inlet of the ejector may be insufficient to remove the refrigerant leaving the evaporator. There is therefore a risk that the pressure of refrigerant leaving the evaporator increases to a level which causes the first inlet of the valve arrangement to be opened. This may be undesirable, and therefore the pressure of the refrigerant leaving the evaporator needs to be decreased. This can be obtained by increasing the mass flow of refrigerant being supplied from the outlet of the evaporator to the secondary inlet of the ejector. However, if this is not sufficient, the first inlet of the valve arrangement will be opened, and a switch to the second mode or operation is performed.

Finally, if the comparison reveals that the detected pressure of refrigerant leaving the evaporator is between the lower threshold value and the upper threshold value, this is an indication that the pressure of refrigerant leaving the evaporator is within an acceptable range. Therefore the compressor unit is, in this case, operated in order to maintain the pressure inside the receiver.

BRIEF DESCRIPTION OF THE DRAWING

The invention will now be described in further detail with reference to the accompanying drawing in which FIG. 1 is a diagrammatic view of a vapour compression system being controlled using a method according to an embodiment of the invention.

DETAILED DESCRIPTION

FIG. 1 is a diagrammatic view of a vapour compression system 1 being controlled using a method according to an embodiment of the invention. The vapour compression system 1 comprises a compressor unit 2, comprising a number of compressors 3, two of which are shown, a heat rejecting heat exchanger 4, a high pressure valve 5, an ejector 6, a receiver 7, an expansion device 8, in the form of an expansion valve, and an evaporator 9 arranged in a refrigerant path. The receiver 7 comprises a liquid outlet 10 and a gaseous outlet 11. The liquid outlet 10 is connected to the expansion device 8, i.e. the liquid part of the refrigerant in the receiver 7 is supplied to the evaporator 9, via the expansion device 8.

A three way valve 12 is mounted in the refrigerant path with a first inlet 13 connected to an outlet of the evaporator 9, a second inlet 14 connected to the gaseous outlet 11 of the receiver 7, and an outlet 15 connected to the compressors 3 of the compressor unit 2. Accordingly, the three way valve 12 controls the supply of refrigerant to the compressor unit 2, via the outlet 15, from the outlet of the evaporator 9, via the first inlet 13, and from the gaseous outlet 11 of the receiver 7, via the second inlet 14, respectively.

Refrigerant leaving the heat rejecting heat exchanger 4 is divided between the high pressure valve 5 and a primary inlet 16 of the ejector 6, in such a manner that some of the refrigerant may pass through the high pressure valve 5, and at least some of the refrigerant passes through the ejector 6, via the primary inlet 16, before being supplied to the receiver 7.

A secondary inlet 17 of the ejector 6 is connected to the outlet of the evaporator 9. Thus, refrigerant leaving the evaporator 9 can either be supplied to the secondary inlet 17 of the ejector 6, or to the first inlet 13 of the three way valve 12.

The vapour compression system 1 of FIG. 1 may be operated in the following manner. Refrigerant is compressed by the compressors 3 of the compressor unit 2 before being supplied to the heat rejecting heat exchanger 4. In the heat rejecting heat exchanger 4 heat exchange takes place between the refrigerant and the ambient, in such a manner that heat is rejected from the refrigerant flowing through the heat rejecting heat exchanger 4.

The refrigerant leaving the heat rejecting heat exchanger 4 is supplied to one or both of the high pressure valve 5 and the primary inlet 16 of the ejector 6, as described above, where the refrigerant undergoes expansion before being supplied to the receiver 7.

In the receiver 7 the refrigerant is separated into a liquid part and a gaseous part. The liquid part of the refrigerant is supplied to the expansion device 8, via the liquid outlet 10. The expansion device 8 expands the refrigerant before it is supplied to the evaporator 9. The refrigerant being supplied to the evaporator 9 is in a mixed liquid and gaseous state.

In the evaporator 9 the liquid part of the refrigerant is at least partly evaporated, while heat exchange takes place between the refrigerant and the ambient in such a manner that heat is absorbed by the refrigerant flowing through the evaporator 9. The refrigerant leaving the evaporator 9 is either supplied to the compressor unit 2, via the first inlet 13 of the three way valve 12, or to the secondary inlet 17 of the ejector 6, where the pressure of the refrigerant is increased due to work performed by the refrigerant received at the primary inlet 16 of the ejector 6 from the heat rejecting heat exchanger 4.

The gaseous part of the refrigerant in the receiver 7 is supplied to the compressor unit 2, via the second inlet 14 of the three way valve 12. Thereby the gaseous part of the refrigerant does not undergo the expansion introduced by the expansion device 8, and the work required by the compressors 3 of the compressor unit 2 in order to compress the refrigerant is thereby reduced.

The vapour compression system 1 of FIG. 1 may be operated in a first mode of operation or in a second mode of operation. The three way valve 12 can be controlled in such a manner that it determines whether the vapour compression system 1 is operated in the first mode of operation or in the second mode of operation.

In the first mode of operation the first inlet 13 of the three way valve 12 is kept closed, and the second inlet 14 of the three way valve 12 is kept open. Thereby, the three way valve 12 ensures that refrigerant is supplied from the gaseous outlet 11 of the receiver 7 to the compressors 3 of the compressor unit 2, via the second inlet 14 of the three way valve 12. Furthermore, the three way valve 12 ensures that refrigerant leaving the evaporator 9 is not allowed to reach the compressors 3 of the compressor unit 2, since the first inlet 13 of the three way valve 12 is closed. Instead, all of the refrigerant leaving the evaporator 9 is supplied to the secondary inlet 17 of the ejector 6. Thus, in the first mode of operation the ejector 6 performs well, and this situation corresponds to a 'summer mode' as described above.

In the second mode of operation the first inlet 13 of the three way valve 12 is kept open, and the second inlet 14 of the three way valve 12 is arranged to bypass vapour in order to maintain a pressure level in the receiver 7. Thereby, the three way valve 12 allows refrigerant leaving the evaporator 9 to be supplied to the compressors 3 of the compressor unit 2, via the first inlet 13 of the three way valve 12. The second inlet 14 of the three way valve 12 is normally closed, but will open in the case that the pressure inside the receiver 7 increases above a maximum threshold value. Accordingly, the second inlet 14 of the three way valve 12 in this case operates as a bypass valve. This situation corresponds to a 'winter mode' as described above.

When the vapour compression system 1 is operated in the second mode of operation, it may be operated in the following manner.

Initially it is determined whether or not conditions for operating the vapour compression system 1 in the first mode of operation are prevailing. This may simply include measuring the outside temperature, and if this is sufficiently high it is determined that it will be beneficial to operate the vapour compression system 1 in the first mode of operation, i.e. in the 'summer mode'.

As an alternative, the temperatures of refrigerant at the first inlet 13 of the three way valve 12, at the second inlet 14 of the three way valve 12, and at the outlet 15 of the three way valve 12 may be measured, and the measured temperatures may be compared. Based on the comparison, it may be determined how large a portion of the refrigerant being supplied to the compressor unit 2 originates from the first inlet 13 of the three way valve 12, and how large a portion originates from the second inlet 14 of the three way valve 12. Alternatively or additionally, a flow direction of the refrigerant at the first inlet 13 of the three way valve 12 may be determined, based on the comparison of the measured temperatures, as described above.

As another alternative, the flow direction of refrigerant at the first inlet 13 of the three way valve 12 may be determined by modulating an opening degree of the first inlet 13 of the three way valve 12, and monitoring a pressure of the refrigerant at the first inlet 13 of the three way valve 12. This has also been described above.

In the case that it is determined that conditions for operating the vapour compression system 1 in the first mode of operation, the first inlet 13 of the three way valve 12 is actively closed, and the second inlet 14 of the three way valve 12 is fully opened. Thereby the three way valve 12 is actively moved into a state where refrigerant leaving the evaporator 9 is prevented from being supplied to the compressors 3 of the compressor unit 2, but is instead supplied to the secondary inlet 17 of the ejector 6. Furthermore, it is ensured that gaseous refrigerant is supplied from the gaseous outlet 11 of the receiver 7 to the compressors 3 of the compressor unit 2 to a maximum extent, since the second inlet 14 of the three way valve 12 is fully open. Accordingly, the three way valve 12 is actively moved to a state which causes the vapour compression system 1 to be operated in the first mode of operation, when the right conditions are present.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling a valve arrangement in a vapour compression system, the vapour compression system comprising a compressor unit comprising one or more compressors, a heat rejecting heat exchanger, an ejector, a receiver, an expansion device and an evaporator arranged in a refrigerant path, wherein an outlet of the heat rejecting heat exchanger is connected to a primary inlet of the ejector, an outlet of the ejector is connected to the receiver, an outlet of the evaporator is connected to a secondary inlet of the ejector and to a first inlet of the valve arrangement, a gaseous outlet of the receiver is connected to a second inlet of the valve arrangement, and an outlet of the valve arrangement is connected to an inlet of the compressor unit, the valve arrangement thereby being arranged to supply refrigerant to the compressor unit from the gaseous outlet of the receiver and/or from the outlet of the evaporator, the method comprising the steps of:

defining a first mode of operation of the vapour compression system, in which the valve arrangement is operated to keep the first inlet of the valve arrangement closed and to keep the second inlet of the valve arrangement open, defining a second mode of operation of the vapour compression system, in which the valve arrangement is operated to keep the first inlet of the valve arrangement open and to operate the second inlet of the valve arrangement to bypass vapour in order to maintain a pressure level in the receiver, when operating the vapour compression system in the second mode of operation:

determining whether conditions for operating the vapour compression system in the first mode of operation are prevailing, and actively closing the first inlet of the valve arrangement and fully opening the second inlet of the valve arrangement based on the determination that the conditions for operating the vapour compression system in the first mode of operation are prevailing.

2. The method according to claim 1, wherein the step of determining whether the conditions for operating the vapour compression system in the first mode of operation are prevailing comprises the steps of:

determining a distribution of refrigerant supplied to the valve arrangement, including determining how large a portion of the refrigerant being supplied from the outlet of the valve arrangement to the compressor unit is received in the valve arrangement via the first inlet, and how large a portion is received via the second inlet, and determining that conditions for operating the vapour compression system in the first mode of operation are prevailing if the portion of refrigerant received via the second inlet of the valve arrangement exceeds a predefined percentage of the refrigerant supplied from the outlet of the valve arrangement to the inlet of the compressor unit, said predefined percentage being at least 70%.

3. The method according to claim 2, wherein the step of determining a distribution of refrigerant supplied to the valve arrangement comprises measuring a temperature of refrigerant entering the valve arrangement via the first inlet, a temperature of refrigerant entering the valve arrangement via the second inlet, and a temperature of refrigerant leaving the valve arrangement via the outlet, and comparing the measured temperatures.

4. The method according to claim 2, wherein the step of determining a distribution of refrigerant supplied to the valve arrangement comprises determining an opening degree of the second inlet of the valve arrangement.

5. The method according to claim 2, wherein the step of determining a distribution of refrigerant supplied to the valve arrangement comprises the step of determining a flow direction of refrigerant at the first inlet of the valve arrangement.

6. The method according to claim 5, wherein the step of determining a flow direction of refrigerant at the first inlet of the valve arrangement comprises the steps of:

modulating an opening degree of the first inlet of the valve arrangement, and measuring changes in a pressure of refrigerant at the first inlet of the valve arrangement in response to the modulation of the opening degree of the first inlet of the valve arrangement.

7. The method according to claim 1, wherein the step of determining whether the conditions for operating the vapour compression system in the first mode of operation are prevailing comprises the steps of:

measuring a parameter of the vapour compression system, where an enthalpy of refrigerant leaving the heat rejecting heat exchanger can be derived from the measured parameter, and determining that conditions for operating the vapour compression system in the first mode of operation are prevailing if the measured parameter exceeds a predefined threshold value.

8. The method according to claim 1, wherein the valve arrangement is or comprises a three way valve.

9. The method according to claim 1, wherein the vapour compression system further comprises a high pressure valve interconnecting an outlet of the heat rejecting heat exchanger and an inlet of the receiver, the high pressure valve being arranged in parallel to the ejector, and wherein refrigerant leaving the heat rejecting heat exchanger is divided into a flow passing through the high pressure valve and a flow passing through the ejector, via the primary inlet of the ejector.

10. The method according to claim 1, wherein the vapour compression system is arranged to have a transcritical refrigerant flowing in the refrigerant path.

11. The method according to claim 1, wherein the heat rejecting heat exchanger is a gas cooler.

12. The method according to claim 3, wherein the step of determining a distribution of refrigerant supplied to the valve arrangement comprises determining an opening degree of the second inlet of the valve arrangement.

13. The method according to claim 3, wherein the step of determining a distribution of refrigerant supplied to the valve arrangement comprises the step of determining a flow direction of refrigerant at the first inlet of the valve arrangement.

14. The method according to claim 4, wherein the step of determining a distribution of refrigerant supplied to the valve arrangement comprises the step of determining a flow direction of refrigerant at the first inlet of the valve arrangement.

15. The method according to claim 2, wherein the valve arrangement is or comprises a three way valve.

16. The method according to claim 3, wherein the valve arrangement is or comprises a three way valve.

17. The method according to claim 4, wherein the valve arrangement is or comprises a three way valve.

18. The method according to claim 5, wherein the valve arrangement is or comprises a three way valve.

19. The method according to claim 6, wherein the valve arrangement is or comprises a three way valve.

20. The method according to claim 7, wherein the valve arrangement is or comprises a three way valve.

* * * * *